United States Patent [19]

Inoue et al.

[11] Patent Number: 5,040,952

[45] Date of Patent: Aug. 20, 1991

[54] SCROLL-TYPE COMPRESSOR

[75] Inventors: Toshinobu Inoue, Numazu; Satoru Oikawa, Fuji; Katutoshi Kumashiro, Shizuoka; Hirotsugu Sakata, Chigasaki, all of Japan

[73] Assignee: Kabushiki Kaisha Toshiba, Kawasaki, Japan

[21] Appl. No.: 486,424

[22] Filed: Feb. 28, 1990

[30] Foreign Application Priority Data

| | | | |
|---|---|---|---|
| Feb. 28, 1989 | [JP] | Japan | 1-47246 |
| Feb. 28, 1989 | [JP] | Japan | 1-47271 |
| Feb. 28, 1989 | [JP] | Japan | 1-47274 |
| Jul. 27, 1989 | [JP] | Japan | 1-88381[U] |

[51] Int. Cl.[5] ..... F04B 21/00; F04C 18/04

[52] U.S. Cl. ..... 417/312; 417/366; 417/902; 418/55.1; 418/181; 418/188

[58] Field of Search ..... 417/312, 366, 902; 418/188, 55.1, 181

[56] References Cited

U.S. PATENT DOCUMENTS

| | | | |
|---|---|---|---|
| 4,357,132 | 11/1982 | Kousokabe . | |
| 4,781,542 | 11/1988 | Ozu et al. | 418/188 X |
| 4,846,640 | 7/1989 | Nishida et al. | 418/188 X |
| 4,904,165 | 2/1990 | Fraser, Jr. et al. | 417/312 |
| 4,911,620 | 3/1990 | Richardson, Jr. et al. | 418/181 |
| 4,929,160 | 5/1990 | Inoue | 418/181 X |

FOREIGN PATENT DOCUMENTS

| | | | |
|---|---|---|---|
| 0253049 | 1/1988 | European Pat. Off. | 418/55.1 |
| 51-34012 | 8/1976 | Japan . | |
| 57-18491 | 1/1982 | Japan . | |
| 59-23094 | 2/1984 | Japan . | |
| 62-013790 | 1/1987 | Japan | 418/55.1 |
| 1-147185 | 6/1989 | Japan | 418/55.1 |

*Primary Examiner*—Louis J. Casaregola
*Assistant Examiner*—Timothy S. Thorpe
*Attorney, Agent, or Firm*—Cushman, Darby & Cushman

[57] ABSTRACT

A scroll-type compressor includes a hermetic case in which a compression section having a pair of spiral scrolls and a motor section for driving the compression section are arranged. The motor section has a rotating shaft coupled to the compression section. A flow passage is formed in the shaft and communicates at its one end with the compression chamber of the compression section and at its other end with a muffler chamber defined above the motor section. An operating fluid compressed in the compression chamber is guided into the muffler chamber through the flow passage, flows around the motor section, and then is discharged from the case.

14 Claims, 5 Drawing Sheets

SCROLL-TYPE COMPRESSOR

BACKGROUND OF THE INVENTION

1. Field of the Invention

The present invention relates to a scroll-type compressor which comprises a hermetic case, a motor section arranged in the upper region in the case, and a scroll-type compression section arranged in the lower region in the case.

2. Description of the Related Art

Published Unexamined Japanese Patent Application (PUJPA) No. 63-134890 discloses an example of a scroll-type compressor, wherein a motor section and a scroll-type compression section are arranged in the upper and lower regions in a hermetic case, respectively. In this compressor, a suction pipe is provided for in the upper wall of the case, and the fixed scroll of the compression section comprises a suction port formed in the circumferential portion thereof and a discharge port formed in the central region thereof. A discharge pipe is connected to the discharge port.

During the operation of the compressor, gas sucked into the case from the suction pipe is introduced into the compression chamber of the compression section through the suction port. In the compression chamber, the gas is compressed in accordance with the orbiting or circling motion of the movable scroll. After being compressed, the gas is discharged from the case through the discharge port of the fixed scroll and through the discharge pipe.

The compressor having the above construction has the following problems. First, it produces a comparatively loud noise since the compressed gas is discharged directly from the scroll-type compression section to the outside of the case after passing through the discharge pipe. Second, the compressed gas to be discharged is likely to mix with the lubricating oil contained in the case. Since, therefore, the amount of lubricating oil stored in the case easily decreases, it is likely that the sliding faces of the compression section will be easily abraded or seize up. Thus, the compressor is not very reliable in operation.

SUMMARY OF THE INVENTION

The present invention has been developed in consideration of the above circumstances, and its object is to provide a scroll-type compressor which does not produce a loud noise.

Another object of the present invention is to provide a scroll-type compressor which does not produce a loud noise and which prevents a decrease in the amount of lubricating oil stored in the case and thus permits the compression section to be satisfactorily lubricated over a long time of use.

To achieve these objects, the scroll-type compressor of the present invention comprises: a hermetic case; a compression section arranged in the case and provided with first and second scrolls which include first and second spiral wraps, respectively, said first and second scrolls being engaged with each other to define a compression chamber therebetween; means for supplying an operating fluid to the compression chamber; drive means arranged in the case and located above the compression section, for driving at least one of the first and second scrolls to move the scrolls in orbiting movement relative to each other, said drive means having a rotating shaft coupled to the compression section, the rotating shaft having a flow passage which communicates with the compression chamber and introduces the operating fluid from the compression chamber to a region above the drive means; muffler means for reducing noise of the operating fluid flowing out the flow passage and supplying the operating fluid into a region inside the case: and discharge means for discharging the operating fluid from said region inside the case to the outside thereof.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 through 5 illustrate a scroll-type compressor according to a first embodiment of the present invention, in which:

FIG. 1 is a longitudinal sectional view of the entire compressor,

FIG. 2 is an enlarged sectional view of a compressor, section of the compressor, FIG. 3 is a plan view of a valve body of a check valve mechanism, FIG. 4 is a sectional view showing the closed state of the check valve mechanism, and FIG. 5 is a second check valve;

DETAILED DESCRIPTION OF THE PREFERRED EMBODIMENT

Embodiments of the present invention will now be described in detail, with reference to the accompanying drawings.

Figure 1:
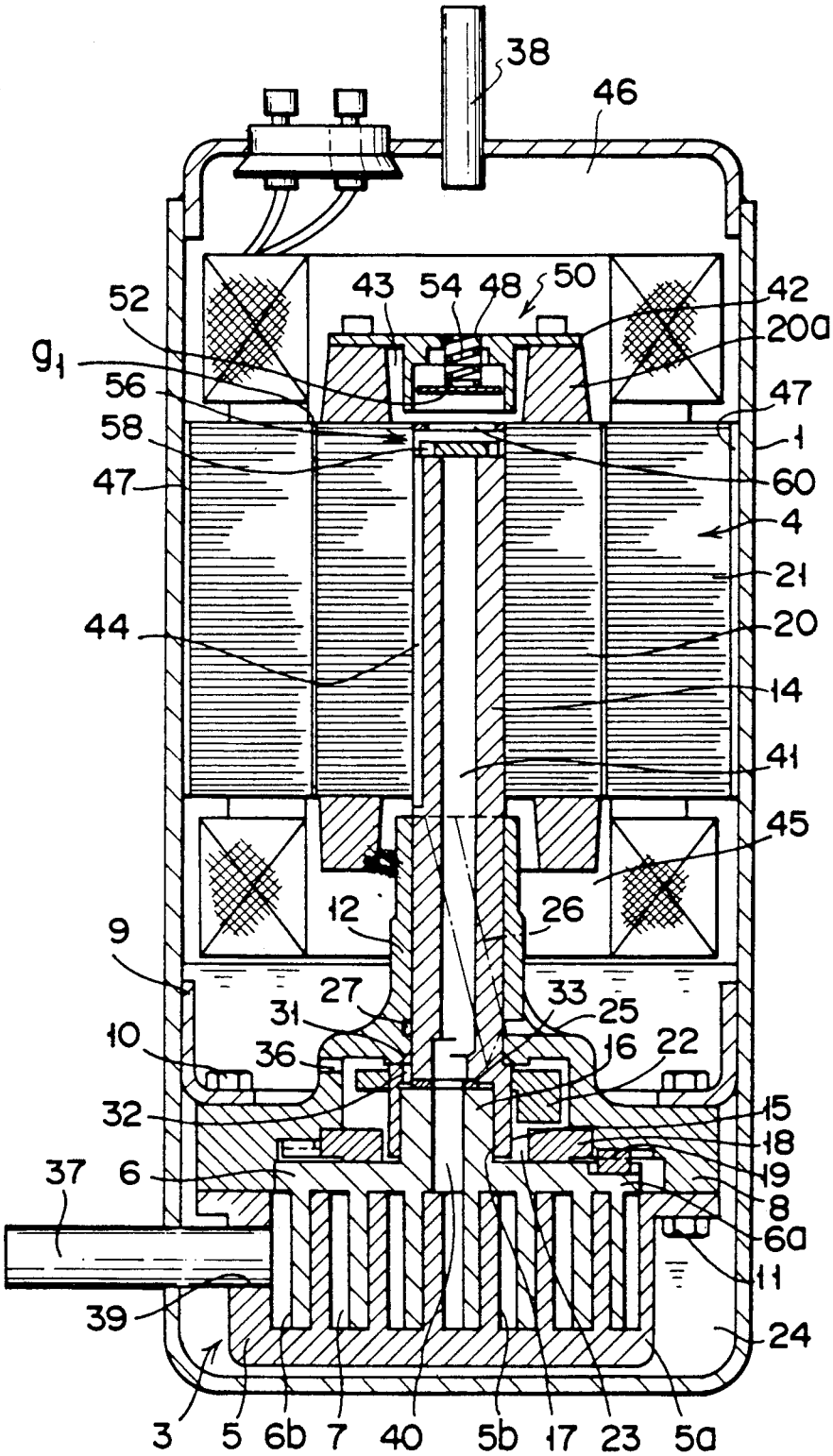
Figure 2:
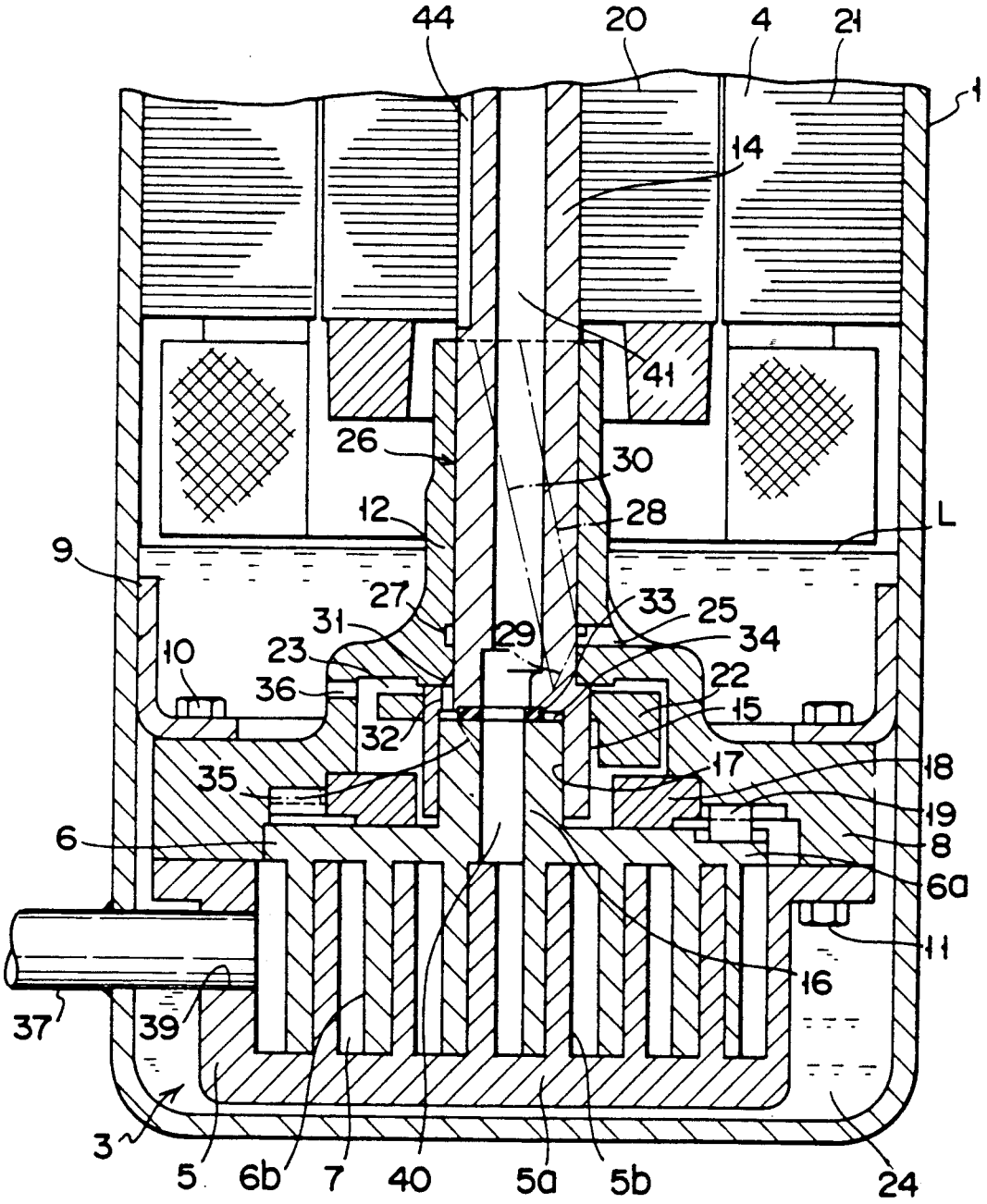

As is shown in FIGS. 1 and 2, a scroll-type compressor according to a first embodiment of the invention comprises a substantially cylindrical hermetic case 1, both ends of which are closed. A scroll-type compression section 3 is arranged in the lower region in the case 1, and an electric motor section 4 for driving the compression section 3 is arranged in the upper region in the case 1.

The motor section 4 includes an annular stator 21 secured to the inner circumferential surface of the case 1, a cylindrical rotor 20 coaxially arranged inside the stator 21, with a gap g1 maintained with reference to the stator 21, and a rotating shaft 14. The upper half of the rotating shaft 14 is fitted in the inner hole of the rotor 20, while the lower half thereof projects downward from the motor section 4. The motor section 4 divides the interior of the case 1 into an upper pressure chamber 46 located above the motor section 4, and a lower pressure chamber 45 located below the motor section 4. The compression section 3 is arranged in this lower pressure chamber 45. A discharge pipe 38 is fixed to the upper end wall of the case 1, whereby the upper pressure chamber 46 communicates with the outside of the case 1.

The compression section 3 comprises a support frame 8 secured, by means of bolts 10, to a stationary plate 9 which is fixed to the inner wall of the case 1 by means of forcible insertion, shrinkage fit, or the like. The support frame 8 integrally includes a cylindrical bearing portion 12 projecting upward from the central portion thereof. This bearing portion 12 rotatably supports the lower half of the rotating shaft 14. The compression section 3 further comprises a fixed scroll 5 fixed to the lower surface of the support frame 8 by means of bolts 11, and a movable scroll 6 coupled to the rotating shaft 14 and orbiting with reference to the fixed scroll 5.

To be more specific, the fixed scroll 5 includes a discoid end plate 5*a*, and a wrap 5*b* having a spiral shape, e.g., an involute shape, and projecting from the end plate 5*a* vertically upward. Likewise, the movable scroll 6 includes a discoid end plate 6*a* facing the end plate 5*a* of the fixed scroll 5, and an involute-shaped wrap 6*b* projecting from the end plate 6*a* vertically downward. The wraps 5*b* and 6*b* engage with each other. defining a substantially crescent compression chamber 7 therebetween. A suction port 39 communicating with the compression chamber 7 is formed in the outermost portion of the wrap 5*b* of the fixed scroll 5, and a suction pipe 37 is connected to the suction port 39 and extends through the circumferential wall of the case 1.

A boss 16 projecting upward is formed in the center of the end plate 6*a* of the movable scroll 6, and a crank 15 having a circular engagement recess 17 is formed at the lower end of the rotating shaft 14. The boss 16 is fitted in the engagement recess 17. The boss 16 and the engagement recess 17 are eccentric to the rotating shaft 14. In other words, their central axes are shifted from the central axis of the rotating shaft 14 by a predetermined distance. An annular thrust bearing 18 is provided on that face of the support frame 8 which is opposite the upper surface of the end plate 6*a* of the movable scroll 6. An Oldham ring 19 is arranged on the outer side of the thrust bearing 18, so as to prevent the movable scroll 6 from rotating. A balance weight 22 is fixed to the outer circumference of the crank 15 and located within an annular space 23 defined within the support frame 8.

In the bottom of the case 1, an oil reservoir 24 containing an lubricating oil is defined. The compression section 3 and the support frame 8 are immersed in the lubricating oil in this oil reservoir. A suction hole 25 is formed in the lower end portion of the bearing portion 12 of the support frame 8, so as to introduce the lubricating oil into the bearing portion 12. The amount of lubricating oil contained in the oil reservoir 24 is determined such that the oil surface L is substantially at the axial center of the bearing portion 12. Under any operating condition of the compressor, therefore, the oil surface L is at a higher level than that of the suction hole 25.

An oil supply groove 26 is formed between the sliding surface of the bearing portion 12 and that of the rotating shaft 14, so as to guide the lubricating oil sucked through the suction hole 25 to the region between the sliding surfaces. As may be seen more clearly in FIG. 2, the oil supply groove 26 includes an annular groove 27 formed in the inner surface of the bearing portion 12 and communicating with the suction hole 25, and first, second, and third spiral grooves 28, 29 and 30 formed in either the inner surface of the bearing portion 12 or the outer surface of the rotating shaft 14. In this embodiment, the first and second spiral grooves 28 and 29 are formed in the inner surface of the bearing portion 12, and the third spiral groove 30 is formed in the outer surface of the rotating shaft 14. One end of the first groove 28 communicates with the annular groove 27, while the other end thereof extends to the upper end of the bearing portion 12. One end of the second groove 29 communicates with the annular groove 27, like the first groove, but the other end thereof extends to the lower end of the bearing portion 12. The first groove 28 is a spiral groove which is turned upward so as to guide the lubricating oil from the annular groove 27 to the upper end of the bearing portion 12, due to the centrifugal force produced when the rotating shaft 14 is rotated. The second groove 29 is a spiral groove which is turned downward so as to guide the lubricating oil from the annular groove 27 to the lower end of the bearing portion 12, due to the centrifugal force produced when the rotating shaft 14 is rotated. The third groove 30 extends between the upper and lower ends of the bearing portion 12. It is turned upward to guide the lubricating oil from the lower end of the bearing portion 12 to the upper end thereof, due to the centrifugal force produced when the rotating shaft 14 is rotated.

An annular groove 31 having a substantially triangular cross section is formed in the inner surface of the lower end of the bearing portion 12. This annular groove 31 communicates with the lower end of the second groove 29. Further, an oil-introducing hole 32 is formed in the crank 15 of rotating shaft 14. The upper end of this oil-introducing hole 32 communicates with the annular groove 31, while the lower end thereof is open in the bottom of the engagement recess 17. Packing 33 in the form of a ring is arranged between the inner bottom of the engagement recess 17 and the upper end face of the boss 16 of the movable scroll 6, so as to separate the oil path from a gas passage to be mentioned later. An oil-storing chamber 34 communicating with the oil-introducing hole 32 is defined on the outer side of the packing 33. A fourth groove 35 is spirally formed in the inner surface of the engagement recess 17. Along this groove 35, the lubricating oil in the oil storing chamber 34 is guided to the lower end of the recess 17, and is then introduced into the annular space 23 containing the balance weight 22. An oil hole 36 is formed in the support frame 8 so as to return the lubricating oil from the space 23 to the oil reservoir 24.

The boss 16 has a discharge hole 40 extending in the axial direction. The upper end of the discharge hole 40 is open to the upper end face of the boss 16, while the lower end thereof is open to the lower face of the end plate 6*a* of the movable scroll 6 and thus communicates with the compression chamber 7. The rotating shaft 14 has a gas passage 41 formed therein and extending from the lower end of the shaft 14 to the upper end thereof.

The lower end of the passage 41 communicates with the discharge hole 40 of the boss 16, via the path defined by the inner circumference of the packing 33.

An upper end ring 20*a* is fixed to the upper end face of the rotor 20 of the motor section 4. The upper opening of the ring 20*a* is closed by a cover plate 42 fixed to the upper end of the ring 20*a*. The cover plate 42 and the ring 20*a* jointly define a muffling chamber 43 partitioned from the upper pressure chamber 46 of the case 1. The upper end of the gas passage 41 of the rotating shaft 14 is open into the muffling chamber 43. An axially-extending communication groove 44 is formed on the outer surface of the rotating shaft 14. The communication groove 44 serves as a first compressed gas flow passage, through which the muffling chamber 43 communicates with the lower pressure chamber 45 in the case 1. With this construction, the operating gas compressed in the compression chamber 7 of the compression section 3 is guided to the muffling chamber 43 through the discharge hole 40 and the gas passage 41, and is then guided to the lower pressure chamber 45 through the communication groove 44.

In the motor section 4, a gap g1 is defined between the outer circumference of the rotor 20 and the inner circumference of the stator 21, as mentioned above. A plurality of axially-extending communication grooves 47 are formed between the outer circumference of the stator 21 and the inner surface of the case 1. The gap g1 and the communication grooves 47 jointly serve as a second compressed gas flow passage, through which the compressed gas is guided from the lower pressure chamber 45 to the upper pressure chamber 46.

Figure 3:
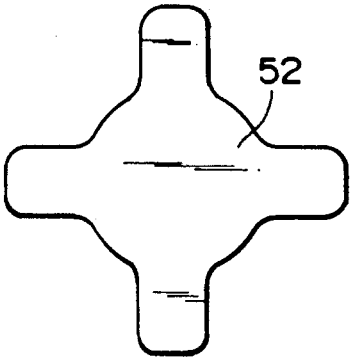
Figure 4:
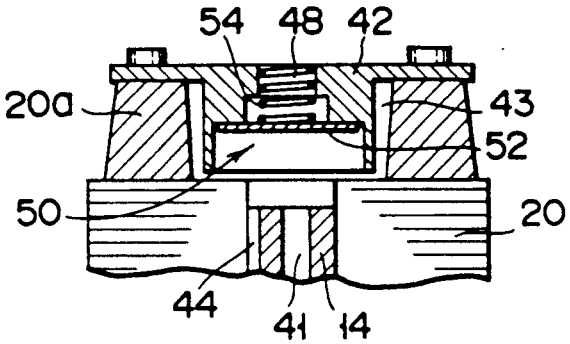

As is shown in FIG. 1, the coverplate 42 has an outlet port 48 through which the compressed gas is discharged from the muffling chamber 43 to the upper pressure chamber 46. At the cover plate 42 is provided a first check valve 50 which opens or closes the outlet port 48 in response to the temperature of the compressed gas within the muffling chamber 43. The valve 50 has a coil spring 54, and a valve body 52 formed by a cross-shaped plate, as is shown in FIG. 3. One end of the coil spring 54 is fixed to the valve body 52, while the other end thereof is fitted in the outlet port 48. The coil spring 54 is formed of a shape memory material, such as a shape memory alloy or shape memory resin, and therefore expands or contracts in response to a temperature variation. When the temperature of the compressed gas in the muffling chamber 43 is lower than a predetermined value, the spring 54 expands and maintains this condition, as is shown in FIG. 1. As a result, the valve body 52 is separated from the cover plate 42, thus opening the outlet port 48. When the temperature of the compressed gas is higher than the predetermined value, the spring 54 contracts and maintains this condition, as is shown in FIG. 4. As a result, the outlet port 48 is closed by the valve body 52.

Figure 5:
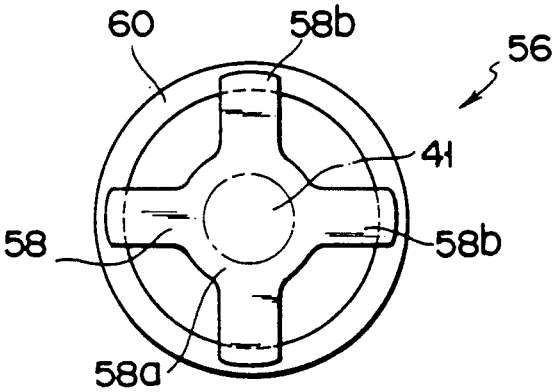

As is shown in FIGS. 1 and 5, inside the rotor 20, a second check valve 56 for preventing the compressed gas from flowing back to the compression section 3 is arranged between the upper end of the rotating shaft 14 and the muffling chamber 43. The valve 56 comprises a cross-shaped valve body 58, and a holding ring 60 which is fitted in the inner hole of the rotor 20 to prevent the valve body 58 from separating from the rotor 20. The valve body 58 includes a discoid central portion 58*a*, and four arms 58*b* radially extending from the central portion 58*a*. The area of the central portion 58*a* is larger than the area of the opening of the gas passage 41, but is smaller than the cross sectional area of the inner hole of the rotor 20. The outer diameter of the entire valve body 58 is larger than the inner diameter of the holding ring 60.

A description will now be given of the operation of the scroll-type compressor having the above-mentioned construction.

During the operation of the compressor, the rotating shaft 14 is rotated together with the rotor 20. With the rotation of the rotating shaft 14, the movable scroll 6 of the compression section 3 moves in orbiting movement with reference to the fixed scroll 5, so that the volume of the compression chamber 7 is gradually decreased from the outermost region to the central region. Therefore, an operating gas is sucked from the suction pipe 37 into the compression chamber 7 where it is compressed. After compression, the gas is discharged from the discharge hole 40 formed in the boss 16 of the movable scroll 6, passes through the gas passage 41 of the rotating shaft 14, and opens the second check valve 56, with the valve body 58 raised by the discharge pressure of the gas. Thus, the compressed gas flows into the muffling chamber 43, where the noise arising from the compressed gas is reduced. When the temperature of the compressed gas flowing into the muffling chamber 43 is higher than a predetermined temperature, the spring 54 of the first check valve 50 is kept in the contracted condition, so that the outlet port 48 of the cover plate 42 is closed by the valve body 52, as is shown in FIG. 4. After the noise is reduced in the muffling chamber 43, therefore, the compressed gas is guided into the lower pressure chamber 45 through the communication groove 44 formed in the outer surface of the rotating shaft 14. The compressed gas is further guided into the upper pressure chamber 46 through the gap g1 defined between the rotor 20 and the stator 21 and through the communication grooves 47 formed between the outer surface of the stator 21 and the inner surface of the case 1. Thereafter, the compressed gas is discharged from the compressor through the discharge pipe 38.

When the rotating shaft 14 is rotating, the lubricating oil is sucked into the suction hole 25 and is supplied into the annular groove 27 of the bearing portion 12. Then, the lubricating oil is supplied from the annular groove 27 into the first and second spiral grooves 28 and 29, due to the centrifugal force. The lubricating oil supplied into the first groove 28 is guided to the upper end of the bearing portion 12, while the lubricating oil supplied into the second groove 29 is guided to the lower end of the bearing portion 12. In this manner, the lubricating oil sucked from the suction hole 25 is supplied into the region between the sliding surface of the bearing portion 12 and that of the rotating shaft 14. The lubricating oil guided to the upper end of the bearing portion 12 through the first groove 28 is returned into the oil reservoir 24.

Part of the lubricating oil guided to the lower end of the bearing portion 12 through the second groove 29 is further guided to the upper end of the bearing portion 12 through the third spiral groove 30, and is then returned into the oil reservoir 24. The remaining part of the lubricating oil is supplied into the annular groove 31 formed in the inner wall of the lower end of the bearing portion 12, and is then guided into the engagement recess 17 of the crank 15 through the oil-introducing hole 32. Further, it is supplied into the oil-storing chamber 34 defined on the outer side of the packing 33. From the oil storing-chamber 34, it is guided to the lower end of the engagement recess 17 through the fourth groove 35, thus lubricating the region between the sliding surface of the engagement hollow 17 and that of the boss 16 of the movable scroll 6. Then, it is introduced into the balance weight-containing chamber 23. In this manner, the lubricating oil flowing along the fourth groove 35 lubricates the region between the sliding surface of the engagement recess 17 and that of the boss 16. The lubricating oil introduced into the balance weight-containing chamber 23 is returned to the oil reservoir 24 through the oil hole 36.

When the compressor has just been started or when it performs a defrosting operation, the temperature of the compressed gas discharged from the compression section 3 is lower than the predetermined temperature. In this case, the spring 54 of the first check valve 50 expands and maintains this condition. As is shown in FIG. 1, therefore, the valve body 52 is separated from the cover plate 42, thus opening the outlet port 48. Accordingly, the compressed gas supplied into the muffling chamber 43 flows into the upper pressure chamber 46 through the outlet port 48, and is discharged from the compressor through the discharge pipe 38.

With the scroll-type compressor mentioned above, the operating fluid compressed in the compression section 3 flows through the discharge hole 40, the gas passage 41, the muffling chamber 43, the communication groove 44, the lower pressure chamber 45, the gap g1, the communication grooves 47, and the upper pressure chamber 46, in the order mentioned. While the operating fluid passes these structural components, the noise of the operating fluid is sufficiently reduced. Then, the operating fluid is discharged from the compressor through the discharge pipe 38. In this manner, the interior of the case 1 is used to provide a multi-cavity type muffler structure (i.e., the silencer means). Since the interior of the case 1 is efficiently utilized as a noise-canceling space, the noise generated during the operation of the compressor can be effectively reduced. It should be noted that the muffler structure is provided by employing the structural components indispensable to the compressor, so that no special structural component or part is required to obtain this muffler structure. In this way, a sufficient noise-canceling effect is achieved without employing a complicated structure and without increasing the manufacturing cost.

The multi-cavity muffler structure mentioned above serves as not only silencer means but also gas-liquid separation means. Specifically, when the compressed gas discharged from the compression section 3 flows through the muffler structure, the lubricating oil which may be included in the compressed gas attaches to the walls of the members constituting the grooves, paths, and chambers, whereby the lubricating oil is separated from the compressed gas. Since, therefore, the lubricating oil can be effectively separated from the compressed gas, the amount of lubricating oil stored in the oil reservoir 24 of the case I is prevented from decreasing. As a result, the region between the sliding surfaces of the compression section 3 is sufficiently lubricated, thus increasing the reliability of the compressor.

When the compressed gas flows through the multi-cavity muffler structure (in particular, when it flows through the gap g1 and the communication grooves 47), the motor section 4 is cooled by the compressed gas. Since, therefore, the motor section 4 is prevented from overheating, the operating characteristics of the compressor are improved.

When the temperature of the compressed gas discharged from the compression section 3 is low, as in the case where the compressor has just been started or performs a defrosting operation, the operating fluid is not in a completely gaseous state. In other words, part of the operating fluid is in a liquid state. If this liquid-state operating fluid is included in the lubricating oil stored in the oil reservoir 24, a foaming phenomenon may occur in the oil reservoir 24, or the lubricating oil may blow up. In the case of the above-mentioned embodiment, however, the cover plate 42, which defines the muffling chamber 43, is provided with the first check valve 50. If the temperature of the compressed gas discharged from the compression section 3 is lower than a predetermined temperature, the valve 50 is kept open. Therefore when the compressor has just been started or when it performs a defrosting operation, the outlet port 48 of the cover plate 42 is kept open, thus guiding the compressed gas to the discharge pipe 38 through the outlet port 48 and the upper pressure chamber 46. Since, in this manner, the liquid components of the low-temperature compressed gas are prevented from being mixed with the lubricating oil stored in the oil reservoir 24, the lubricating oil does not foam, nor does it blow up. Thus, a decrease in the amount of lubricating oil stored in the oil reservoir 24 can be prevented further reliably.

In the compressors of a type wherein the pressure in the hermetic case becomes high, when the operation of the compressor is stopped, the pressures in both the upper and lower pressure chambers 45 and 46 become higher than the pressure in the compression chamber 7 of the compression section 3. As a result, the compressed gas in the pressure chambers 45 and 46 is likely to flow back to the compression chamber 7 through the gas passage 41 of the rotating shaft 14. If the compressed gas flows back to the compression chamber 7, the compression section 3 and the motor section 4 may undesirably operate in the reverse fashion. In the case of the embodiment of the present invention, however, a second check valve 56 is provided at the upper end of the gas passage 41 of the rotating shaft 14. If the pressures in the pressure chambers 45 and 46 are higher than the pressure in the compression chamber 7, this pressure difference causes the valve body 58 of the valve 56 to be seated on the upper end face of the rotating shaft 14, thus closing the upper end opening of the gas passage 41. Accordingly, the compressed gas is prevented from flowing back to the compression chamber 7, so that the occurrence of the reverse operation of both the compression section 3 and the motor section 4 is reliably prevented.

In the embodiment mentioned above, the compression section 3 has a fixed scroll 5 and a movable scroll 6. However, the present invention may be applied to a compressor whose compression section has a pair of movable scrolls. In addition, the first and second check valves 50 and 56 may be omitted from the compressor of the above embodiment. Even in the case, the noise reduction, the prevention of a decrease in the amount of the lubricating oil, and the cooling of the motor section are achieved. Moreover, in the above embodiment, the second check valve 56 may be arranged between the lower end of the gas passage 41 of the rotating shaft 14 and the discharge hole 40 of the movable scroll 6. If this arrangement is adopted, the amount of compressed gas which may flow back to the compression section can be further reduced. Further, the first compressed gas flow passage may be formed of a communication groove formed on the inner circumference of the rotor 20 or a passage extending through the rotor.

Figure 6:
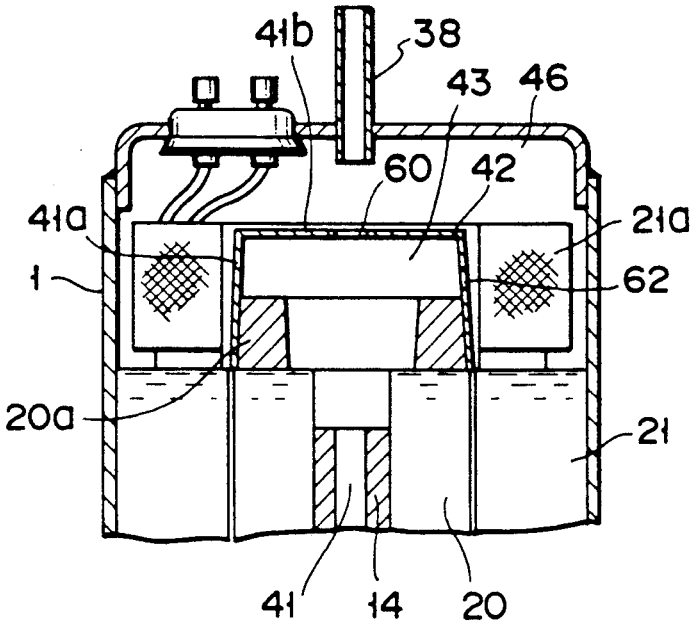
FIG. 6 is a sectional view illustrating an essential part of a scroll-type compressor according to a second embodiment of the present invention.

FIG. 6 illustrates an essential part of a scroll-type compressor according to a second embodiment of the present invention.

In the second embodiment, the compressor comprises a hermetic case 1, and an electric motor section 4 arranged in the upper region in the case 1. A compression section (not shown), which is similar in construction to the compression section of the first embodiment, is arranged in the lower region in the case 1. The compression section is connected to the motor section 4 by a rotating shaft 14. As will be mentioned below, the second embodiment differs from the first embodiment, in the structures for reducing noise and separating a liquid from a gas.

Referring to FIG. 6, a cap-shaped cover member 42 is fixed to the upper end of the rotor 20 of the motor section 4 and surrounds the upper end ring 20*a* of the rotor 20. The cover member 42 defines a muffling chamber 43 which is partitioned from the upper pressure chamber 46 of the case 1 and which communicates with the gas passage 41 of the rotating shaft 14. The cover member 42 has a circumferential wall 41*a* having a diameter substantially equal to the outer diameter of the rotor 20 and arranged coaxial with the rotor 20, and an upper end wall 41*b* closing the upper end opening of the circumferential wall 41*a* and being perpendicular to the axis of the rotor 20. The upper end wall 41*b* is located at a level slightly lower than the level of an upper coil end ring 21*a* fixed to the upper end of the stator 21.

An outlet port 60 for allowing communication between the muffling chamber 43 and the upper pressure chamber 46 is formed substantially in the center of the upper end wall 41*b*. One or a plurality of oil discharge ports 62 are formed in the circumferential wall 42*a* such that they are opposite to the inner surface of the end ring 21*a*.

In the compressor of the second embodiment, the compressed gas discharged from the compression section flows into the muffling chamber 43 through the gas passage 41 of the rotating shaft 14. After the noise of the compressed gas is reduced, the compressed gas is supplied into the upper pressure chamber 46 through the outlet port 61, and is then discharged from the compressor through the discharge pipe 38.

During the operation of the compressor, the cover member 42 rotates together with the rotor 20. Therefore, the compressed gas supplied into the muffling chamber 43 swirls inside the muffling chamber 43. If a lubricating oil is contained in the compressed gas supplied into the muffling chamber 43, it is subjected to the centrifugal force arising from the swirling motion and is thus scattered radially outward, i.e., toward the circumferential wall 41*a* of the cover member 42, since the mass of the lubricating oil is larger than that of the compressed gas. As a result, the lubricating oil is separated from the compressed gas, and is discharged from the muffling chamber 43 through the oil discharge ports 62. In the meantime, the compressed gas cleared of the lubricating oil is discharged into the upper pressure chamber 46 through the outlet port 60.

With the compressor of the second embodiment, the diameter of the circumferential wall 41*a* of the cover member 42 is substantially equal to the outer diameter of the rotor 20. Since, therefore, the muffling chamber 43 has a large volume, the noise of the compressed gas can be sufficiently reduced. In addition, since the diameter of the muffling chamber 43 is large, the lubricating oil contained in the compressed gas can be subjected to a large centrifugal force, with the result that the lubricating oil can be reliably separated from the compressed gas. Accordingly, the movable components of the compressor can be satisfactorily lubricated over a long time of use, thus improving the reliability of the compressor.

The height and diameter of the cover member 42 are determined so that the cover member 42 is housed inside the coil end ring 21*a* of the stator 21. Therefore, the noise-canceling effect and gas-liquid separation effect mentioned above are achieved with no need to increase the size of the entire compressor. Further, the cover member 42 can be installed with no need to alter the structure of the compressor, so that the compressor is easy to manufacture.

Figure 7:
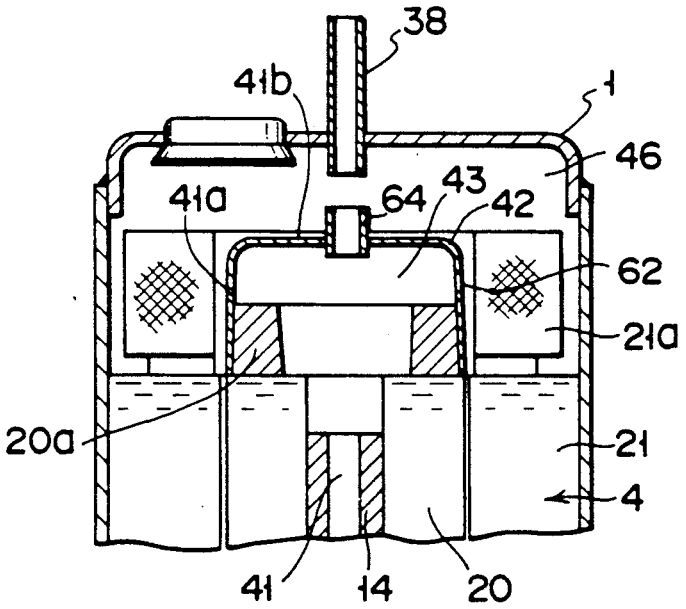
FIG. 7 is a sectional view showing a first modification of a muffler section of the second embodiment.

FIG. 7 illustrates a first modification of the cover member. In this modification, the outlet port is replaced with an outlet pipe 64. This outlet pipe 64 extends through a substantially central portion of the upper end wall 41*b* of the cover member 42.

Figure 8:
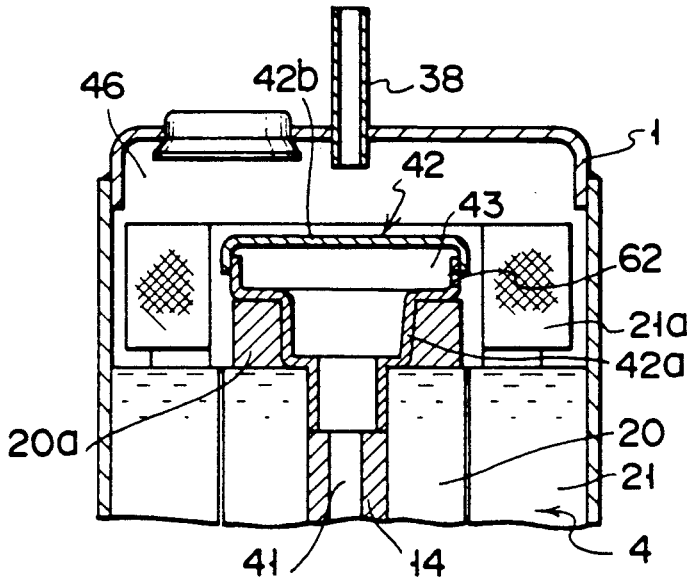
FIG. 8 is a sectional view showing a second modification of the muffler section of the second embodiment.

FIG. 8 illustrates a second modification of the cover member. In this modification, the cover member 42 is made up of a lower member 42*a* and an upper member 42*b*. The lower member 42*a* is bent such that it can be fitted on the inner surface of the inner hole of the rotor 20, the inner and upper end surfaces of the upper end ring 20*a* of the rotor 20. The upper member 42*b* is a discoid member which includes a circumferential portion fitted around the upper end of the lower member 42*a* and which closes the upper end opening of the lower member 42*a*. A discharge port 62 used for discharging the lubricating oil and the compressed gas is formed in that portion of the lower member 42*a* which extends upward from the end ring 20*a*.

Figure 9:
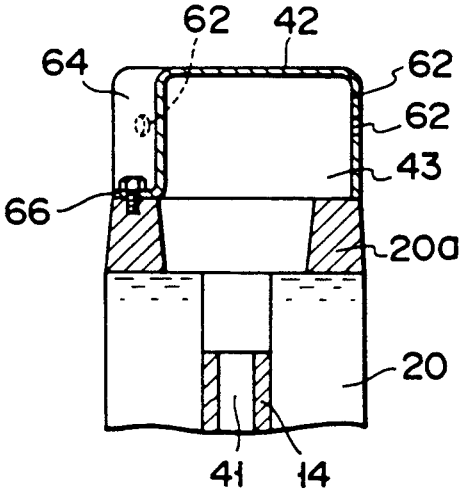
FIG. 9 is a sectional view showing a third modification of the muffler section of the second embodiment.
Figure 10:
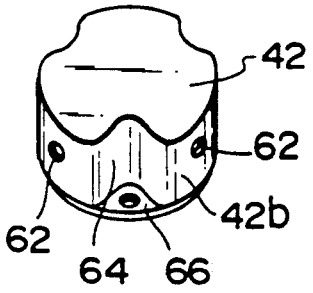
FIG. 10 is a perspective view of the muffler section of the third modification shown in FIG. 9.

FIGS. 9 and 10 illustrate a third modification of the cover member. In this modification, the cover member 42 is shaped like a cap and its lower end is fixed to the upper end of the end ring 20*a*. Three axially-extending depressed sections 64 are provided for the circumferential wall 42*a* of the cover member 42 at equal intervals in the circumferential direction. A flange 66 is formed at the lower end of each depressed section 64. The cover member 42 is secured to the rotor 20 by fixing the flanges 66 to the upper end of the end ring 20*a* by means of bolts. A discharge port 62, used for discharging the lubricating oil and the compressed gas, is formed substantially in the center of that portion of the wall 42*a* which is located between the two adjacent depressed sections 64.

In each of the first to third modifications, the outer diameter and height of the cover member are determined so that the cover member is housed inside the end ring 21*a* of the stator 21. Therefore, advantages substantially similar to those of the second embodiment can be obtained in each of the first to third modifications.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A scroll-type compressor, comprising:

a hermetic case having a first pressure chamber, and an oil storing portion for storing a lubricating oil;

a compression section located in the case and including first and second scrolls which have first and second spiral wraps, respectively, said first and second scrolls engaging to define a compression chamber between the first and second wraps;

means for supplying an operating fluid to the compression chamber;

drive means arranged in the case and located above the compression section, for driving at least one of the scrolls in orbiting movement relative to the other scroll, said drive means including a rotating shaft connected to the compression section, said rotating shaft having a flow passage which communicates with the compression chamber and introduces the operating fluid from the compression chamber to a region above the drive means;

communication means for guiding the operating fluid, passes through the flow passage, into the first pressure chamber by way of the drive means, thereby cooling the drive means with the operating fluid and reducing noise of the operating fluid; and discharge means for discharging the operating fluid from the first pressure chamber to the outside of the case.

2. A compressor according to claim 1, wherein said drive means includes a rotor fixed to the rotating shaft and rotatable together therewith, and is arranged to divide the interior of the case into a first pressure chamber located above the drive means and a second pressure chamber located below the drive means; and said communication means includes a cover member fixed to the rotor and located in the first pressure chamber, said cover member defining a muffling chamber which communicates with the flow passage and is partitioned from the first pressure chamber, and which is used for reducing noise of the operation fluid discharged from the flow passage.

3. A compressor according to claim 2, wherein said communication means includes: first communication means for guiding the operating fluid from the muffling chamber to the second pressure chamber; and second communication means for guiding the operating fluid from the second pressure chamber to the first pressure chamber through the drive means, said discharge means including a discharge pipe communicating with the first pressure chamber.

4. A compressor according to claim 3, wherein said drive means includes an annular stator fixed to an inner surface of the hermetic case, said rotor is substantially cylindrical and is arranged inside the stator, with a predetermined gap maintained with reference to the stator, and said rotating shaft has an upper end portion fitted in an inner hole of the rotor;

said first communication means includes a first communication groove formed between the rotating shaft and an inner surface of the rotor and allows communication between the muffling chamber and the second pressure chamber; and said second communication means has an annular gap defined between an inner circumference of the stator and an outer circumference of the rotor and allows communication between the first and second pressure chambers.

5. A compressor according to claim 4, wherein said second communication means includes a second communication groove formed between the outer circumference of the stator and the inner surface of the hermetic case and allows communication between the first and second pressure chambers.

6. A compressor according to claim 3, wherein said cover member has an outlet port for allowing communication between the muffling chamber and the first pressure chamber, and which further comprises:

first valve means for closing the outlet port when the operating fluid temperature introduced into the muffling chamber exceeds a predetermined temperature, and for opening the outlet port when the operating fluid temperature is lower than said predetermined temperature.

7. A compressor according to claim 6, wherein said first valve means includes a valve body for opening and closing the outlet port, and a holding member connecting the valve body to the cover member, said holding member being formed of a shape memory material which maintains a first shape at a temperature higher than the predetermined temperature and a second shape at a temperature lower than the predetermined temperature, said first shape causing the valve body to close the outlet port, and said second shape causing the valve body to open the outlet port.

8. A compressor according to claim 7, wherein said holding member is a coil spring having one end fixed to the valve body and another end fitted in the outlet port.

9. A compressor according to claim 2, wherein said rotor is substantially cylindrical, said rotating shaft has an upper end portion fitted in an inner hole of the rotor, and said cover member includes a circumferential wall having a diameter substantially equal to an outer diameter of the rotor and arranged coaxial with the rotor, and a discharge hole formed in the circumferential wall and allowing communication between the muffling chamber and the first pressure chamber.

10. A compressor according to claim 9, wherein said drive means includes a substantially annular stator fixed to an inner surface of the hermetic case and located on the outer side of the rotor, and an end ring mounted on an upper end face of the stator and projecting into the first pressure chamber, said cover member having such a size as enables the cover member to be housed in a space defined by an inner circumference of the end ring.

11. A compressor according to claim 1, which further comprises valve means for preventing the operating fluid to flow back to the compression chamber.

12. A compressor according to claim 11, wherein said valve means includes a valve body arranged to prevent communication between the compression chambers and said region in the hermetic case when the pressure in said region exceeds that in the compression chamber.

13. A compressor according to claim 12, wherein said communication means includes a muffling chamber that communicates with the flow passage and which is partitioned from the first pressure chamber, and said valve body is located between the flow passage and the muffling chamber such that the valve body closes the flow passage when the pressure in said region in the case is higher than the pressure in the compression section.

14. A compressor according to claim 1, wherein:

said drive means includes a rotor fixed to the rotating shaft and rotatable together therewith, and a stator fixed to an inner surface of the hermetic case and arranged on an outer side of the rotor, with a predetermined gap maintained with reference to the rotor, said drive means being arranged so as to divide the interior of the case into the first pressure chamber located above the drive means and a second pressure chamber located below the drive means; and said communication means includes: a muffling chamber which communicates with the flow passage and is defined in the first pressure chamber with being partitioned therefrom; first communication passage means for guiding the operating fluid from the muffling chamber to the second pressure chamber through the rotor; and second communication passage means for guiding the operating fluid from the second pressure chamber to the first pressure chamber through a region around the stator.

* * * * *